US007208024B2

(12) United States Patent
Weber

(10) Patent No.: US 7,208,024 B2
(45) Date of Patent: Apr. 24, 2007

(54) FLOOR CARE APPLIANCE WITH FILTER CLEANING SYSTEM

(75) Inventor: Vincent L. Weber, North Lawrence, OH (US)

(73) Assignee: The Hoover Company, North Canton, OH (US)

( * ) Notice: Subject to any disclaimer, the term of this patent is extended or adjusted under 35 U.S.C. 154(b) by 554 days.

(21) Appl. No.: 10/731,380

(22) Filed: Dec. 8, 2003

(65) Prior Publication Data

US 2005/0120510 A1 Jun. 9, 2005

(51) Int. Cl.
*B01D 46/00* (2006.01)

(52) U.S. Cl. ..... 55/288; 55/302; 55/400; 55/DIG. 3; 15/347

(58) Field of Classification Search ..... 55/290, 55/283, 284, 288, 302, DIG. 3, 285; 15/300.1, 15/303, 21.1, 23, 363, 347, 352; 95/279, 95/280, 277, 290, 400
See application file for complete search history.

(56) References Cited

U.S. PATENT DOCUMENTS 4,156,600 A * 5/1979 Jacobson ..... 55/285
4,830,642 A * 5/1989 Tatge et al. ..... 96/426
5,238,473 A * 8/1993 Femiani ..... 55/290
6,458,178 B1 * 10/2002 Dietz et al. ..... 55/302
7,082,640 B2 * 8/2006 McCutchen ..... 15/352
2004/0129649 A1 * 7/2004 Vanhoutte ..... 210/767

* cited by examiner

*Primary Examiner*—Duane Smith
*Assistant Examiner*—Robert Clemente
(74) *Attorney, Agent, or Firm*—A. Burgess Lowe; Michael J. Corrigan

(57) ABSTRACT

The present invention is a floor care appliance having a filter member that has one portion being cleaned at all times. The filter is utilized for separating fine particles from a dirt laden airstream that has been previously cleaned of larger particles. The hollow interior of the filter is divided radially into equally sized elongated portions. The filter is rotated so that one elongated portion of the filter is rotated past a port located at one end of the filter which introduces reverse airflow through the filter to clean the surface of the filter. The entire filter is cleaned with each complete revolution of the filter.

3 Claims, 4 Drawing Sheets

FLOOR CARE APPLIANCE WITH FILTER CLEANING SYSTEM

BACKGROUND OF THE INVENTION

1. Field of the Invention

This invention relates to floor care, and more specifically, to a floor care appliance having a filter cleaning system.

2. Summary of the Prior Art

Floor care appliances are well known in the art. Typical floor care appliances include upright vacuum cleaners, canister vacuum cleaners, hard floor cleaners, and extractors. It is known to provide floor care appliances with filter cleaning systems. It is also known to provide floor care appliances with filter cleaning systems utilizing reverse airflow through the filter to clean the filter. However, it is heretofore unknown to rotate the filter and provide a valve at one end of the filter to allow a reverse flow of air into a portion of the filter that is rotated in front of the valve.

SUMMARY OF THE INVENTION

The present invention is a floor care appliance having a filter that has one portion at a time being cleaned at all times. The filter is utilized for separating fine particles from a dirt-laden airstream that has been previously cleaned of larger particles. The hollow interior of the filter is divided radially into equally sized elongated portions. The filter is rotated so that one portion of the filter is rotated past a port located at one end of the filter. The remaining sections are subject to suction from the motor-fan assembly which draws the dirt-laden airstream into the dirt cup through the filter. The filter is rotated by a means such as an electric motor or an air turbine on the end of the filter opposite the valve. The dirt cup is mounted in the cleaner housing and divided into a lower chamber and an upper chamber by an apertured wall. The apertured wall spans laterally from opposing sidewalls of the dirt cup. The dirty air inlet is located just underneath the higher end of the apertured walls, and the dirt-laden airstream is directed underneath the apertured wall. Some of the airstream will have the effect of blowing through the apertured wall and blowing off any particle buildup on the upper surface of the apertured wall. Since the apertured wall is sloped, the dust buildup blown off will have a tendency to fall towards the lower end of the apertured wall. Another chamber is located behind the lower chamber where dust filtered by the dirt-laden airstream is allowed to fall and collect. The entire dirt cup assembly can be removed for emptying purposes.

DETAILED DESCRIPTION OF THE INVENTION

Figure 1:
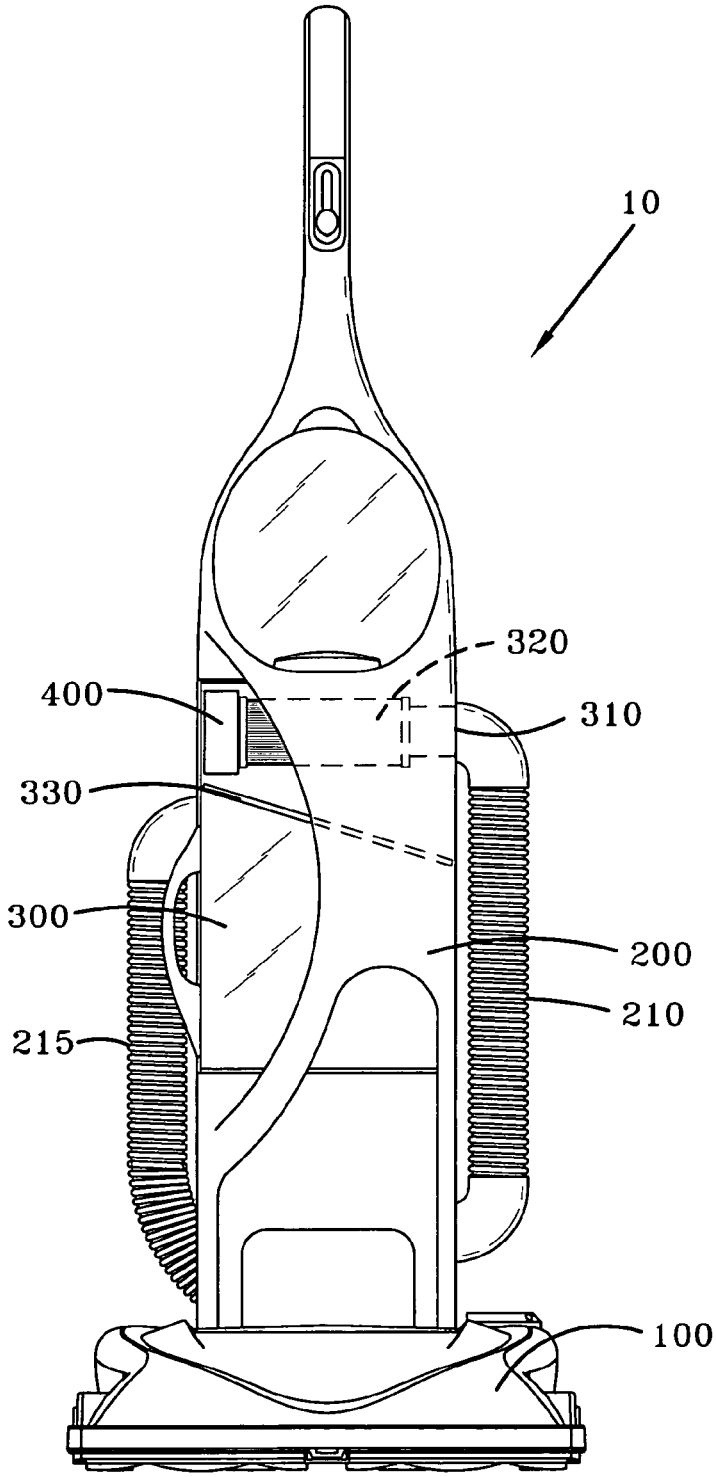
FIG. 1 is a front view of a floor care appliance having a dirt collecting system with a filter cleaning system, according to the concepts of the present invention.
Figure 2:
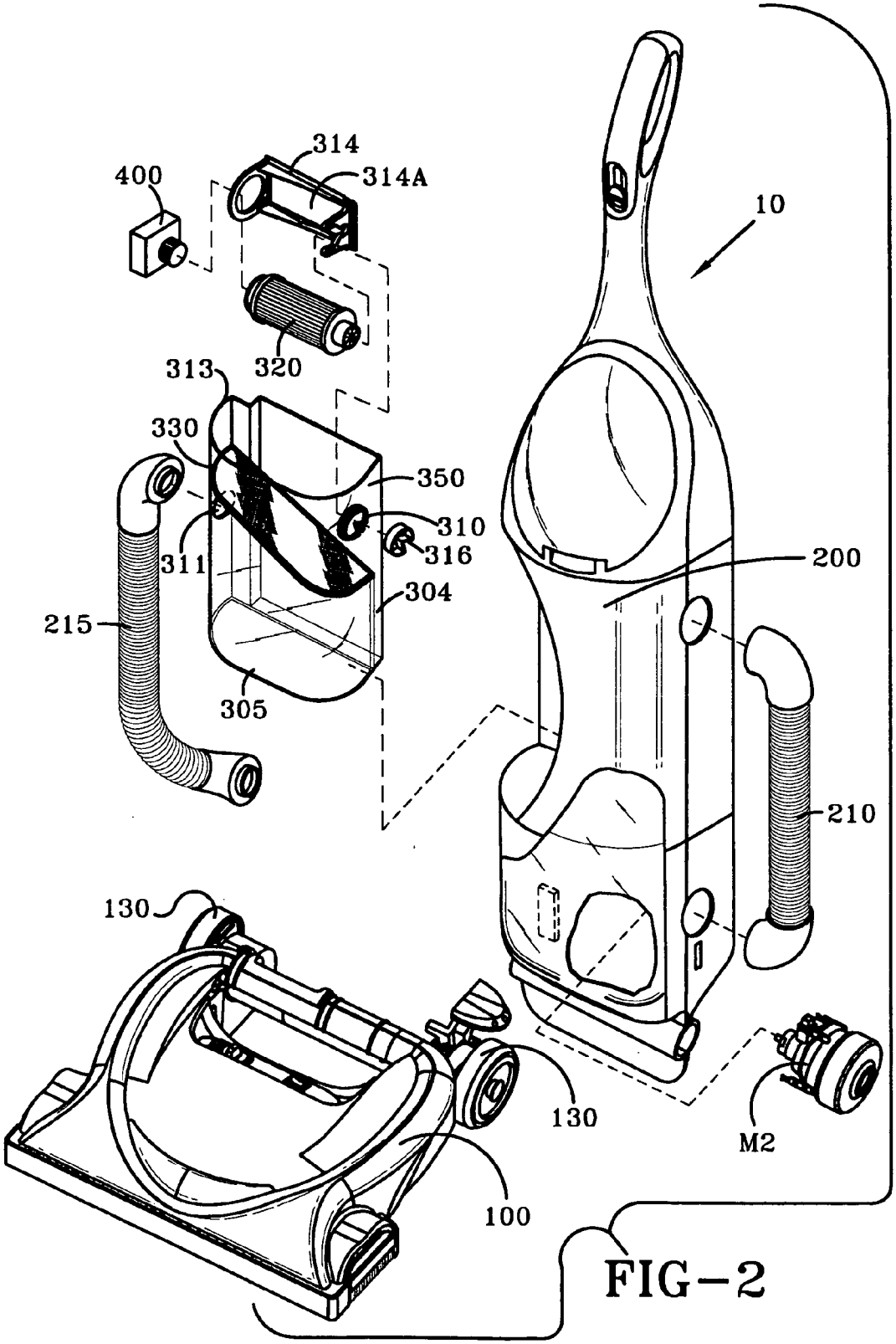
FIG. 2 is an exploded perspective view of the floor care appliance of FIG. 1, according to the preferred embodiment of the present invention.

Referring now to FIGS. 1 and 2, shown is an upright vacuum cleaner 10 having a dirt collecting and filtration system 300, according to the preferred embodiment of the present invention. Although an upright vacuum cleaner 10 is shown, the present invention could be incorporated in any type of floor care appliance, including an extractor, stick or canister cleaner. Upright vacuum cleaner 10 includes a foot 100 and an upper housing assembly 200 pivotally connected to foot 100. Foot 100 is similar to those known in the art and includes a nozzle opening (not shown) for receiving a stream of dirt-laden air and an agitator (not shown) for agitating and loosening dust and debris from a floor surface when upright vacuum cleaner 10 is in the floor care mode. Foot 100 further includes a pair of front wheels (not shown) rotatably mounted on a wheel carriage (not shown) and a pair of rear wheels 130 (FIG. 2).

Located in foot 100 or upper housing 200 is a motor-fan assembly M2 (FIG. 2) which creates the suction necessary to remove the loosened dust and debris from the floor surface. The motor-fan assembly M2 fluidly connects to dirt collecting and filtration system 300 by a dirt duct 210. The upper housing assembly 200 houses a dirt collecting and filtration system 300 for receiving and filtering the dirt-laden airstream which is created by the motor-fan assembly M2. The dirty air inlet 311 is connected to suction nozzle 100 by a dirt duct 215. An independent electric agitator drive motor is provided for providing rotary power for at least one rotary agitator (not shown).

Figure 3:
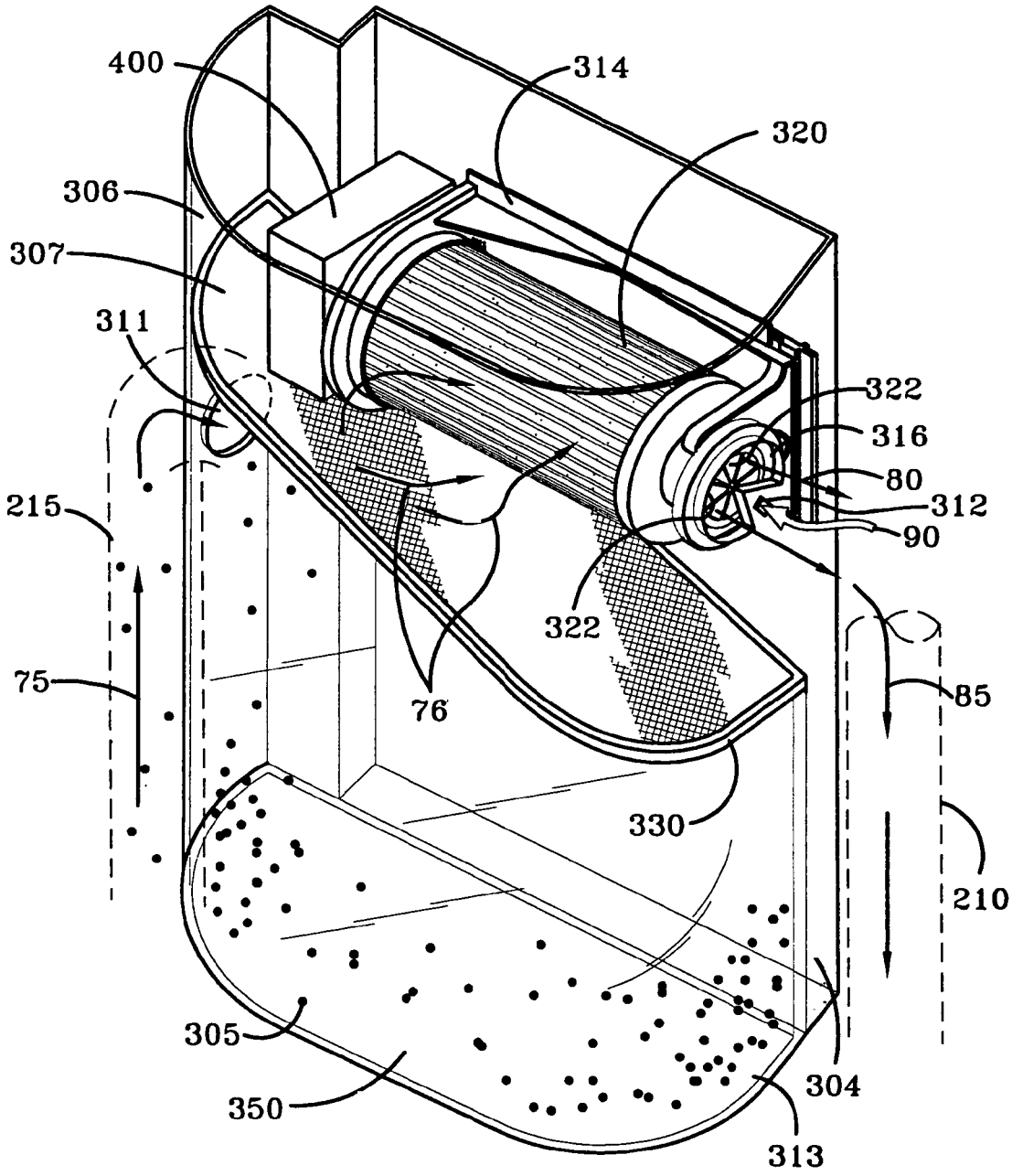
FIG. 3 is a perspective view of the dirt collecting system for a floor care appliance, according to the preferred embodiment of the present invention.

Referring now to FIGS. 2 and 3, shown is an exploded view of a floor care appliance 10 with a preferred embodiment dirt collecting and filtration system 300. Dirt collecting and filtration system 300 includes a translucent dirt cup 350 divided into a first chamber 305 for collecting large debris and a second chamber 306 for collecting fine debris. A rotating cylindrical filter 320 is mounted in the second chamber 306. A frame member 314 holds the filter member 320 in an interior portion 314A, and a motor 400 is coupled to filter member 320.

The hollow interior of the filter member 320 is divided radially into equally sized elongated portions 322. The filter member 320 is rotated so that one portion 322 of the filter member 320 is rotated in front of a port 312 located at one end of the filter member 320. The remaining elongated portions 322 are subject to suction from the motor-fan assembly M2 which draws the dirt-laden airstream into the dirt cup 350 through the filter member 320. The filter member 320 is rotated by an electric motor 400 on the end of the filter member 320 opposite the valve 316. Filter member 320 could be rotated by other means, including an air turbine (not shown). The dirt cup 350 is mounted in the cleaner housing 200 and divided into a lower chamber 305 and an upper chamber 306 by an apertured wall 330. The apertured wall 330 spans laterally from opposing sidewalls of the dirt cup 350. The dirty air inlet 311 is located just underneath the higher end of the apertured wall 330, and the dirt-laden airstreams directed underneath the apertured wall 330. Some of the airstream will have the effect of blowing through the apertured wall 330 and blowing off any particle buildup on the upper surface of the apertured wall 330. Since the apertured wall 330 is sloped, the dust buildup blown off will have a tendency to fall towards the lower end of the apertured wall 330. Another chamber 304 is located behind the lower chamber 305 where dust filtered by the dirt-laden airstream is allowed to fall and collect.

A dirty air inlet 311 on one sidewall 312 introduces the dirt-laden airstream (represented by arrow 75) into the first chamber 305 where large dirt particles are collected. Particles will be collected on a bottom wall 314. The apertured wall 330 prevents the large particles from entering the upper chamber area 306 where the cylindrical filter 320 is located. Suction from the motor-fan assembly M2 is drawn into the dirt cup 350 through a suction inlet 311 in the sidewall 313. The interior of filter 320 is hollow and divided radially into several elongated sections. Filter 320 is closed at one end and rotatably coupled to a motor 400 which rotates filter member 320. After being filtered of large dirt particles by apertured wall 330, the dirt-laden airstream (represented by arrows 76) is filtered of fine dirt particles by filter member 320. Suction from suction inlet 210 is drawn through only the unblocked elongated sections 322 (represented by arrows 80 and 85 in FIG. 3) of filter member 320. The filter member 320 is continuously rotated by an independent drive motor 400 which rotates the open end of filter member 320 past a valve 316. Valve 316 prevents motor suction from drawing airflow through selected elongated portions 322 of filter 320 by blocking airflow from entering the elongated portions 322 in the interior of filter member 320. The remaining unblocked portions 322 allow airflow to be drawn through the interior of filter 320, apertured wall 330, and suction nozzle 100. Valve 316 causes reverse airflow (represented by arrow 90 in FIG. 3) through one of the elongated sections 322 of filter 320 blocked by valve 316 by a port 312 which is open to the atmosphere. The reverse airflow causes any accumulated dust on the exterior of filter member 320 to be blown off and fall into second chamber 304. A port 312 in valve 316 is open to the atmosphere which causes air to flow into the elongated section 322 directly in front of the port 312. Air at atmospheric pressure is allowed to enter into the elongated section 322 and flows through the wall of filter member 320. Since the pressure inside the dirt cup 350 is below atmospheric, air is drawn through the port 312 and through the interior of that portion of filter member 320.

Figure 4:
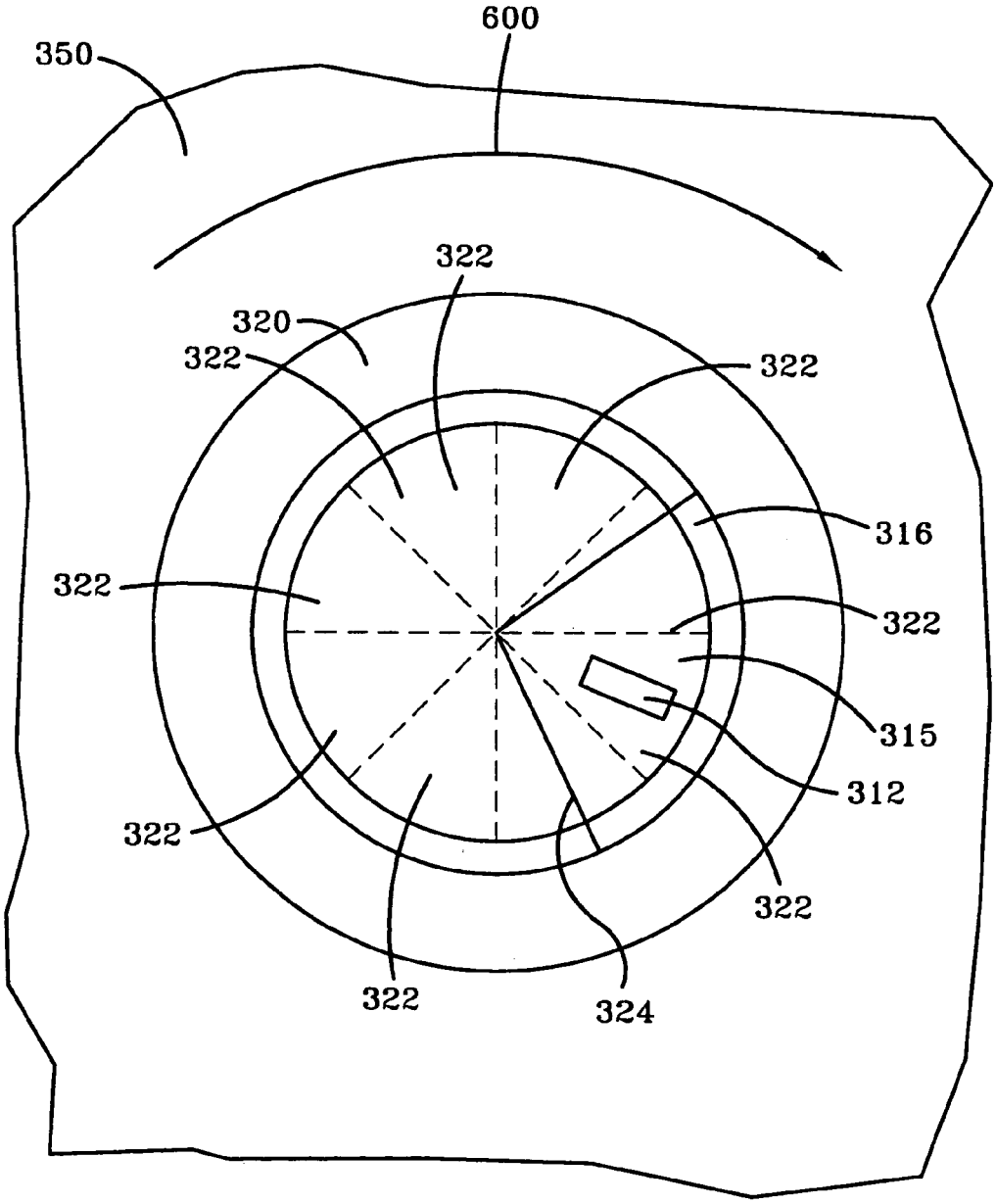
FIG. 4 is a side view of a portion of the dirt collecting system for a floor care appliance of FIG. 1 with the rotating valve with atmospheric port inserted into the suction inlet port of the dirt cup in fluid with communication with the rotating filter, according to the preferred embodiment of the present invention.

Referring now to FIG. 4, shown is the detail of valve 316 and filter 320. As the elongated portions 322 of filter 320 are rotated in the direction of arrow 600 in front of the blocking portion 315 of valve 316, one elongated portion 322 is rotated directly in front of port 312 of valve 316. This exposes this particular elongated portion 322 to the atmosphere which blocking suction from the suction motor M2. Since pressure surrounding the filter 320 is below atmospheric, air is drawn through port 312 into that elongated portion 322 through the filter wall of filter 320, which will dislodge any dust cake buildup on the exterior. In this manner, the entire filter surface will be cleaned with each complete revolution of filter member 320 in the direction of arrow 600.

It should be clear from the foregoing that the described structure clearly meets the objects of the invention set out in the description's beginning. It should now also be obvious that many changes could be made to the disclosed structure which would still fall within its spirit and purview.

The invention claimed is:

1. A floor care appliance, comprising:

a suction nozzle;

a dirt collecting chamber;

a filter member located in the dirt collecting container, said filter member having an interior being divided radially into equally sized elongated portion;

a valve located adjacent to one end of said filter member for allowing suction to be applied to selected portions of said elongated portions;

an apparatus for rotating said filter member so that said one end of said filter member rotates past said valve; and a port located in said valve for allowing atmospheric air to enter one of said elongated portions of said filter when said elongated portion is rotated in front of said port and such that in one full revolution of said filter every one of said elongated portions is rotated past said port.

2. The floor care appliance of claim 1, wherein said apparatus for rotating said filter member is selected from the group consisting of an electric motor and an air turbine.

3. The floor care appliance of claim 1, wherein atmospheric air entering said elongated portion flows through said elongated portion of said filter and through the filter wall into said dirt container to remove any dust cake buildup on the outer surface of said filter wall.

* * * * *